US006645046B1

(12) United States Patent
Vogtmann et al.

(10) Patent No.: US 6,645,046 B1
(45) Date of Patent: Nov. 11, 2003

(54) CONDITIONING MECHANISM IN A CHEMICAL MECHANICAL POLISHING APPARATUS FOR SEMICONDUCTOR WAFERS

(75) Inventors: Michael Vogtmann, Pleasanton, CA (US); Chris Frederickson, Pleasanton, CA (US); Jeff Gasparitsch, Fremont, CA (US); Gene Hempel, Austin, TX (US); Erik Engdahl, Livermore, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/607,743

(22) Filed: Jun. 30, 2000

(51) Int. Cl.[7] ..... B24B 49/00

(52) U.S. Cl. ..... 451/8; 451/41; 451/56; 451/443; 451/444

(58) Field of Search ..... 451/8, 41, 21, 451/56

(56) References Cited

U.S. PATENT DOCUMENTS 3,753,269 A 8/1973 Budman ..... 15/160

(List continued on next page.)

FOREIGN PATENT DOCUMENTS

| | | |
|---|---|---|
| DE | 296 06 925 U1 | 7/1996 |
| EP | 0 362 811 A2 | 4/1990 |
| WO | WO 98/45090 | 10/1998 |
| WO | WO 01/58644 A1 | 8/2001 |

OTHER PUBLICATIONS

U.S. patent application No. 09/475,518: "Method and Apparatus for Conditioning a Polishing Pad" Inventor: Finkelman, Filed: Dec. 30, 1999 Attorney Docket No. 7103–117.

U.S. patent application Ser. No. 09/540,602 "Method and Apparatus for Conditioning a Polishing Pad" Inventor: John M. Boyd, Filed Mar. 31, 2000 Attorney Docket No. 7103–133.

U.S. patent application—Ser. No. pending "Apparatus and Method for Conditioning a Fixed Abrasive Polisning Pad in a Chemical Mechanical Planarization Process" Inventors: Ravkin, et al., Filed: Jun. 30, 2000 Attorney Docket No. 7103–180.

U.S. patent application —Ser. No. pending "Apparatus and Method for Qualifying a Chemical Mechanical Planarization Process" Inventors: Boyd, et al., Filed Jun. 30, 2000 Attorney Docket No. 7103–181.

Copy of International Search Report for PCT Application No. PCT/US01/20594 dated Mar. 1, 2002.

*Primary Examiner*—M. Rachuba
(74) *Attorney, Agent, or Firm*—Brinks Hofer Gilson & Lione

(57) ABSTRACT

A method and apparatus for conditioning a polishing pad are described. The method includes steps of providing a chemical mechanical polishing apparatus having a polishing region and a conditioning region; cycling a polishing member through the apparatus; contacting the polishing member in the conditioning region with a conditioning member; and conditioning the polishing member. The apparatus includes an end effector adapted to receive a conditioning member, the end effector being attached to an arm that can be moved horizontally and vertically, and a strain gauge that monitors the force applied to a polishing member.

13 Claims, 2 Drawing Sheets

U.S. PATENT DOCUMENTS 4,318,250 A 3/1982 Klievoneit et al. ..... 51/134
4,720,939 A 1/1988 Simpson et al. ..... 51/135
4,934,102 A 6/1990 Leach et al. ..... 51/50
5,081,051 A 1/1992 Mattingly et al. ..... 437/10
5,335,453 A 8/1994 Baldy et al. ..... 51/67
5,456,627 A 10/1995 Jackson et al.
5,484,323 A 1/1996 Smith ..... 451/10
5,536,202 A 7/1996 Appel et al. ..... 451/285
5,547,417 A 8/1996 Breivogel et al. ..... 451/58
5,575,707 A 11/1996 Talieh et al. ..... 451/173
5,593,344 A 1/1997 Weldon et al. ..... 451/296
5,611,943 A 3/1997 Cadien et al. ..... 216/88
5,622,526 A 4/1997 Phillips ..... 451/72
5,643,044 A 7/1997 Lund ..... 451/5
5,655,951 A 8/1997 Meikle et al. ..... 451/56
5,692,947 A 12/1997 Talieh et al. ..... 451/41
5,885,137 A * 3/1999 Ploessl ..... 451/56
5,941,762 A 8/1999 Ravkin et al.
6,036,583 A * 3/2000 Perlov et al. ..... 451/56
6,042,457 A * 3/2000 Wilson et al. ..... 451/443
6,080,046 A 6/2000 Shendon et al.
6,086,460 A 7/2000 Labunsky et al. ..... 451/56
6,123,607 A 9/2000 Ravkin et al.
6,283,836 B1 * 9/2001 Fruitman et al. ..... 451/285
6,293,853 B1 * 9/2001 Perlov et al. ..... 451/288
6,306,008 B1 * 10/2001 Moore ..... 451/41

* cited by examiner

CONDITIONING MECHANISM IN A CHEMICAL MECHANICAL POLISHING APPARATUS FOR SEMICONDUCTOR WAFERS

FIELD OF THE INVENTION

The present invention relates to a method and apparatus for conditioning a polishing pad. More particularly, the present invention relates to a method and apparatus for conditioning a polishing pad used in the chemical mechanical planarization of semiconductor wafers.

BACKGROUND

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive toward smaller, more highly integrated circuit designs. Semiconductor wafers are also commonly constructed in layers, where a portion of a circuit is created on a first level and conductive vias are made to connect up to the next level of the circuit. After each layer of the circuit is etched on the wafer, an oxide layer is put down allowing the vias to pass through but covering the rest of the previous circuit level. Each layer of the circuit can create or add unevenness to the wafer that is preferably smoothed out before generating the next circuit layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. A polishing fluid, such as a chemical polishing agent or slurry containing microabrasives, is applied to the polishing pad to polish the wafer. The wafer holder then presses the wafer against the rotating polishing pad and is rotated to polish and planarize the wafer.

With use, the polishing pads used on the wafer polishers become clogged with used slurry and debris from the polishing process. The accumulation of debris reduces the surface roughness and adversely affects polishing rate and uniformity. Polishing pads are typically conditioned to roughen the pad surface, provide microchannels for slurry transport, and remove debris or byproducts generated during the CMP process.

One method for conditioning a polishing pad uses a rotary disk embedded with diamond particles to roughen the surface of the polishing pad. Typically, the disk is brought against the polishing pad and rotated about an axis perpendicular to the polishing pad while the polishing pad is rotated. The diamond-coated disks produce predetermined microgrooves on the surface of the polishing pad. If the rotation is motorized, the motorization can be expensive and can experience mechanical failures.

Presently, polishing and conditioning are typically done on the same side of a rotating platen. On the rotating platen, there is polishing station and a conditioning station. Slurry is dispensed on the platen for polishing. The slurry that is exposed to air on the surface of the platen can eventually dry and crystallize. Some of the dried slurry can rotate around on the platen, making it back to the polishing station where it can then scratch the semiconductor wafer.

One known conditioning mechanism uses an arm having an end effector into which a conditioner pad fits. The arm moves across the polishing pad to condition it. There are problems with the known conditioning mechanisms that use arms. For one, the end effector used on these mechanisms rotates about a gimbal point that is internal to the end effector. This causes uneven wear on the pad in the end effector. Further, the known conditioning mechanisms with arms lack a reliable force feed back system. Previous strain gauges or load cells were mounted in such a way that dried slurry could build up and cause a friction force that would lead to inaccurate data.

SUMMARY

The methods and apparatuses of the present invention address at least some of the problems of the prior art.

In one aspect of the invention, a conditioning mechanism in an apparatus for chemically-mechanically polishing semiconductor wafers comprises a drive mechanism and an arm. The arm has a first end portion, a mid portion, and a second end portion wherein the first end portion is connected with the drive mechanism, and an end effector is mounted to the second end portion. The end effector is adapted to receive a conditioning member for conditioning a polishing member. A strain gauge is preferably configured to monitor the force that the end effector, with the conditioning member therein, applies to the polishing member, preferably mounted to the mid portion of the arm.

In another aspect of the invention, an end effector in a conditioning mechanism in an apparatus for chemically-mechanically polishing semiconductor wafers is provided. The end effector comprises a body attached with an arm of the conditioning mechanism, an area on the body adapted to receive a conditioning member for conditioning a polishing member, and a bearing surface supporting that area on the body and providing a gimbal point about which the area rotates thereby minimizing digging of the conditioning member into the polishing member during polishing.

In still another aspect of the invention, a method of conditioning a polishing member in a chemical mechanical polishing apparatus for semiconductor wafers is provided. The method comprises providing a chemical mechanical polishing apparatus having a polishing region and a conditioning region, the conditioning region being opposite the polishing region, and cycling a polishing member around a plurality of rollers in a chemical mechanical polishing apparatus for semiconductor wafers such that, at any given time, a portion of the polishing member is in the polishing region and a portion of the polishing member is in the conditioning region. A conditioning member in a conditioning mechanism contacts the polishing member in the conditioning region and conditions the polishing member.

In yet another aspect of the invention, a combination of a chemical mechanical polishing apparatus and a conditioning mechanism is provided. The combination comprises a frame of the chemical mechanical polishing apparatus, a plurality of rollers mounted to the frame, a polishing member wrapped around the rollers such that such that, at any given time, a portion of the polishing member is in a polishing region and a portion of the polishing member is in a conditioning region opposite the polishing region. The conditioning is mechanism attached to the frame such that a conditioning member, when placed in the conditioning mechanism, can be moved to contact the polishing member in the conditioning region.

The present invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PRESENTLY PREFERRED EMBODIMENTS

FIGS. 1, 2, 3, and 4 depict, respectively, a CMP apparatus, a conditioning mechanism therein, a closed loop feedback system used on the conditioning mechanism, and an end effector on the conditioning mechanism.

CMP APPARATUS

Figure 1:
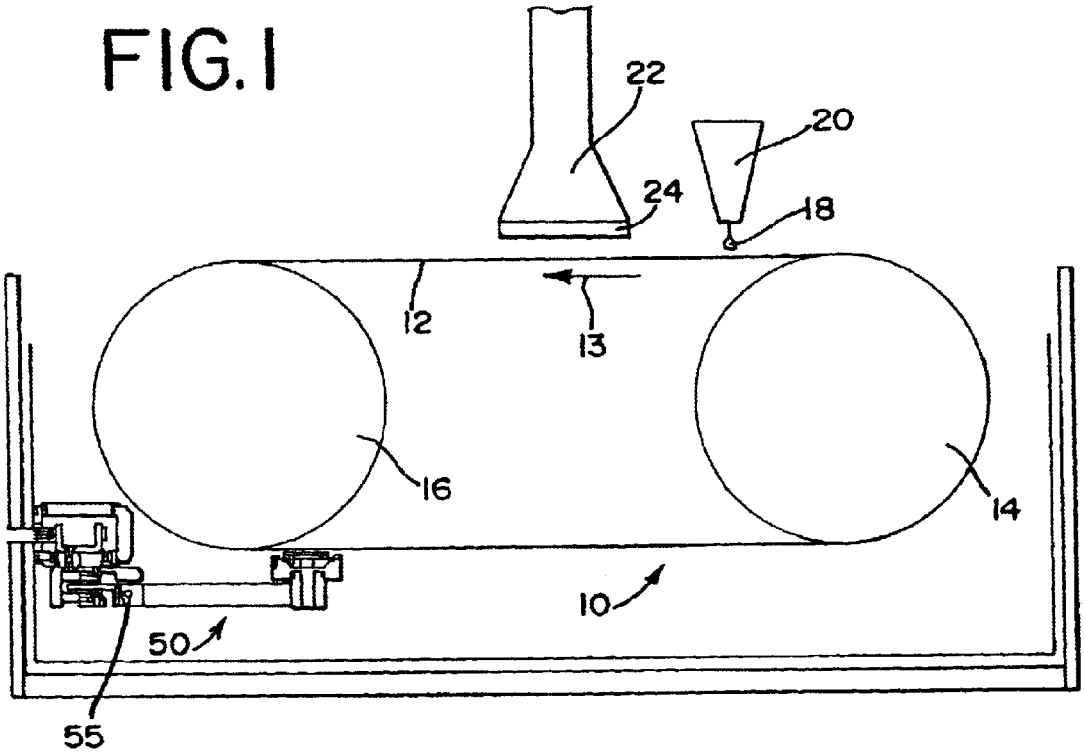
FIG. 1 shows a side view of a chemical mechanical polishing apparatus for semiconductor wafers.

Referring to FIG. 1, a side view of a CMP apparatus is shown. Although the present invention may be used with many CMP apparatuses, linear apparatuses are preferred. FIG. 1 shows a linear polishing tool 10. An example of a linear polishing tool is the TERES wafer polisher available from Lam Research Corporation of Fremont, Calif. A conditioning mechanism 50 is used in combination with the linear polishing apparatus 10.

In one embodiment, the linear polishing tool 10 polishes away materials on the surface of a semiconductor wafer 24. The removed material can be the substrate material of the wafer itself or one of the layers formed on the substrate. Such formed layers include dielectric materials (such as silicon dioxide or silicon nitride), metals (such as aluminum, copper, or tungsten), metal alloys or semiconductor materials (such as silicon or polysilicon). More specifically, the linear polishing tool 10 uses CMP to polish or remove one or more of these layers fabricated on the wafer 24 to planarize the surface layer.

In one embodiment, the linear polishing tool 10 uses a pad with a coupled belt (hereinafter the pad and belt are collectively referred to as "polishing member 12") that moves linearly with respect to the surface of wafer 24. Other types of linear polishing members, such as integrated pad/belt combinations, are also suitable. The polishing member 12 is a continuous polishing member rotating about rollers 14 and 16. A driving means, such as an electric motor, applies a rotational motion that causes polishing member 12 to move in a linear motion with respect to the wafer 24 as shown by direction arrow 13. A portion of polishing member 12 moving from roller 14 to roller 16 is in the top region 27, where polishing of wafer 24 occurs. The portion of the polishing member 12 moving from roller 16 to roller 13 is the bottom region 29, where conditioning of polishing member 12 occurs.

Each roller typically comprises a stainless steel cylinder, which generally comprises a diameter of around 12 inches. Although the present invention uses stainless steel for the rollers, other materials are suitable as well including a stainless steel covered metal. And although the present invention generally uses a roller with a diameter of around 12 inches, other diameters for the rollers are suitable as well. Additionally, both rollers further comprise roller pads, with each roller pad being approximately 0.5" of rubber, although other materials and thickness's are suitable for use as well. The length of rollers 14 and 16 (with their respective roller pads) are generally the same as the width of the polishing member 12, which is typically 12 inches to 14 inches.

The wafer 24 is held by wafer carrier 22. The wafer 24 is held in position by a mechanical retaining means (such as a retainer ring) and/or by a vacuum in the wafer carrier 22. The wafer carrier 22 positions the wafer atop polishing member 12 so that the surface of the wafer comes in contact with the pad portion of polishing member 12. The wafer carrier 22 rotates to rotate the wafer 24. The rotation of the wafer 24 provides the averaging for the planarization of the polishing contact with the wafer surface.

The linear polishing tool 10 additionally contains a slurry dispensing mechanism 20, which dispenses a slurry 18 onto polishing member 12. The slurry 18 is a mixture of de-ionized water and abrasive polishing agents designed to chemically aid the smooth and predictable planarization of the wafer. Any of a number of commercially available slurries may be used. A slurry dispensing mechanism 20 dispenses the slurry 18 onto polishing member 12 before a semiconductor wafer 24 supported in spindle 22 is polished. When the wafer 24 is polished, the used and sometimes crystallized and otherwise hardened slurry 18 slides off of roller 16, and polishing member 12 is conditioned using conditioning mechanism 50. Advantageously, the use of an linear polishing tool 10 having a top region 27 and a bottom region 29 helps ensure that hardened slurry falls off of the apparatus.

CONDITIONING MECHANISM

Figure 2:
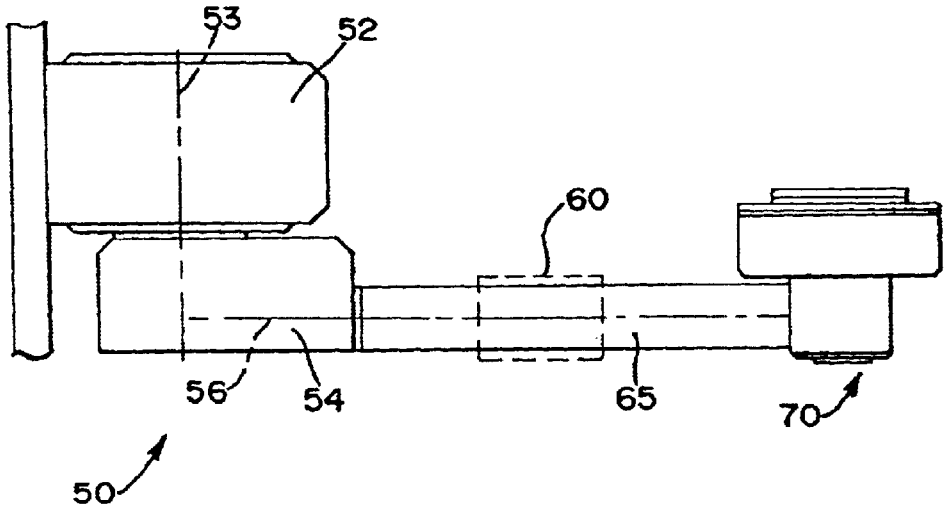
FIG. 2 shows a side view of a conditioning mechanism that can be used on the chemical mechanical polishing apparatus of FIG. 1.

Referring to FIG. 2, a side view of the conditioning mechanism 50 is shown. Generally, conditioning mechanism 50 comprises a drive mechanism having sweeping driver 52, vertical driver 54, an arm 65, and an end effector 70. This section focuses on the drive mechanism and the arm 65 and the end effector 70 is described in detail in its own section.

Sweeping driver 52 is attached to a frame 5 using any attachment means or mechanism known in the art. Sweeping driver 52 can be attached to the frame 5 using pins, bolts, screws, and the like. Sweeping driver 52 can be attached to the frame 5 using adhesives. Sweeping driver 52 can be attached through welding, molding and other like techniques.

Sweeping driver 52 is configured to sweep end effector 70 and the conditioner pad 85 associated with end effector 70 across polishing member 12. Sweeping driver 52 can sweep the end effector 70 and the conditioner pad 85 across polishing member 12 linearly, or using one end of the arm 65 as a pivot, it can sweep the end effector 70 and the conditioning pad 85 therein in an arc.

Sweeping driver 52 may produce the sweeping motion of arm 65 through hydraulics, pneumatics, mechanical means, electrical means, electro-mechanical means, or a fuel-burning motor. Preferably, sweeping driver 52 is powered by a motor/reducer assembly. A suitable assembly is commercially available through companies such as Animatics, located in Santa Clara, Calif.

Vertical driver 54 is attached to sweeping driver 52 using any attachment means or mechanism known in the art. Vertical driver 54 can be attached to sweeping driver 52 using pins, bolts, screws, and the like. Vertical driver 54 can be attached to sweeping driver 52 using adhesives. Vertical driver 54 can be attached to sweeping driver 52 through welding, molding and other like techniques.

Vertical driver 54 moves arm 65 up and down about pivot point 55. Vertical driver 54 is selectively operable to raise the end effector 70 and the conditioner pad 85 therein in contact with polishing member 12 for conditioning. When conditioning is stopped, vertical driver 54 also lowers the end effector 70 and pad conditioner 85 out of contact with polishing member 12.

Vertical driver 54 causes the up and down motion of arm 65 through hydraulics, pneumatics, mechanical means, electrical means, electro-mechanical means, or a fuel-burning motor. Preferably, vertical driver 54 is powered by a bellow style pneumatic actuator. A suitable vertical driver 54 is commercially available through companies such as Festo, Inc. located in Hauppauge, N.Y.

Arm 65 is attached to both the end effector 70 and the drive assembly. Arm 65 can be attached to the end effector 70 using pins, bolts, screws, and the like. Arm 65 can be attached to the end effector 70 using adhesives. Arm 65 can be attached to the end effector 70 through welding, molding and other like techniques.

Figure 3:
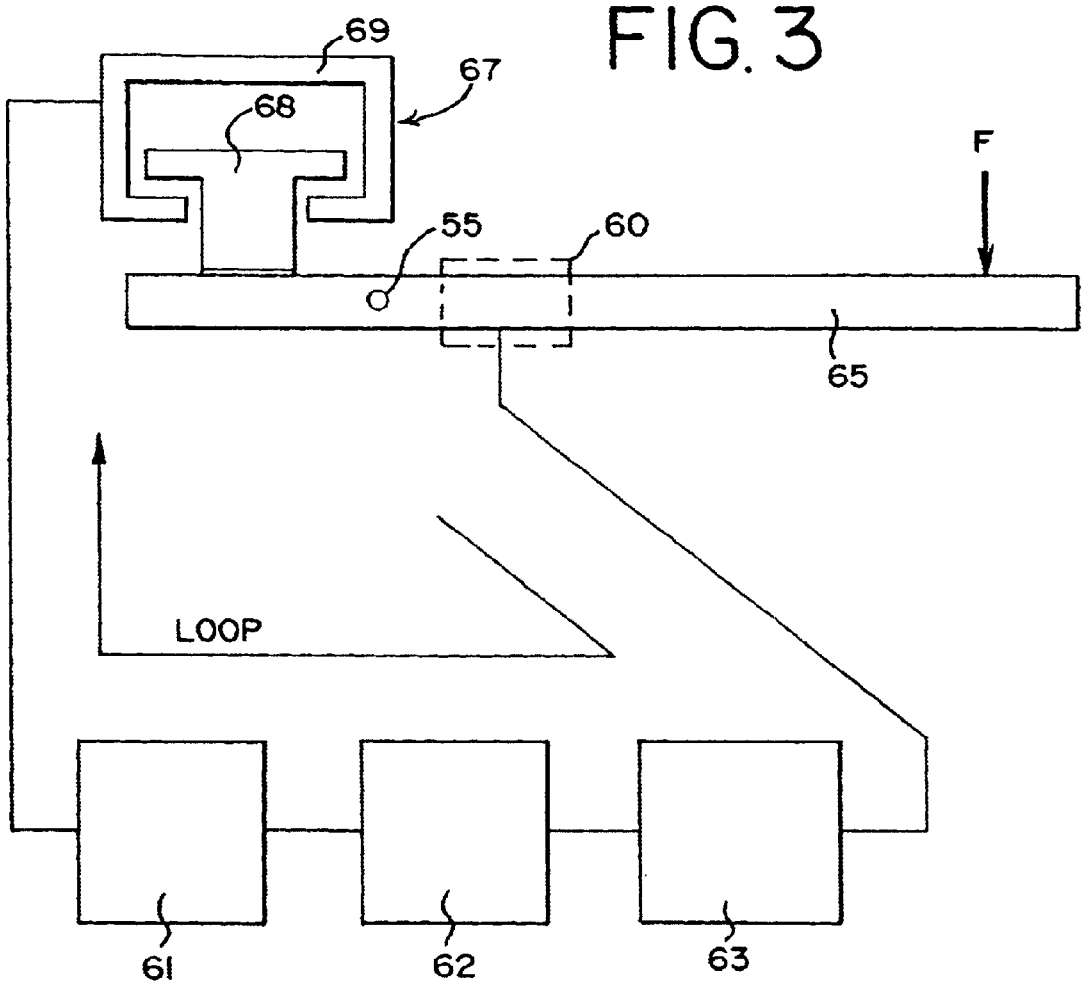
FIG. 3 shows a side view of a closed loop feed back system used on the chemical mechanical polishing apparatus of FIG. 1.

Referring to FIGS. 2 and 3, a strain gauge 60, also known as a load cell, is used to monitor the conditioning force that conditioner pad 85 and end effector 70 apply to polishing member 12, preferably through a closed loop feedback system. Any commercially available strain gauge 60 can be used for this purpose. Strain gauges are readily available and inexpensive. An exemplary manufacturer of strain gauges is HBM Weighing Technology, headquartered in Darmstadt, Germany.

In a preferred embodiment, a strain gauge 60 is installed onto arm 65 and calibrated by a third-party installation service such as HITECH, located in Westford, Mass.

Generally, a preferred strain gauge 60 works as follows. In advance, a user decides how much force is tolerable for end effector 70 and the conditioner pad 85 therein to apply to the polishing member 12. Generally, this can range from 0 to 20 lbs and more, preferably from 2 to 8 lbs. For purposes of an example, the user sets a set point at 5 pounds of force.

Before end effector 70 and the conditioner pad 85 contact the polishing member 12, deflection force is calibrated to indicate 0 pounds of force, which also indicates 0 pounds of force against polishing member 12.

Once contact made between the conditioner pad 85 and the polishing member 12, this generates a deflection force in arm 65, which a transducer turns into an electronic signal that is systematically amplified using amplifier 63 and sent to a controller 62. Change in current or voltage (some embodiments measure change in current, others may measure change in voltage) relates formulaically to change in deflection force, which relates formulaically to a change in the force conditioner pad 85 applies to the polishing member 12. A controller 62 figures the force applied to polishing member 12 (the change in force from 0 pounds, in the present example). When the force is greater than the set point, or 5 lbs in this example, the system self-adjustments to reduce the force.

Referring to FIG. 3, a preferred closed loop feedback system is shown. The "F" arrow indicates the force acting on arm 65 when arm 65 contacts polishing member 12. The strain gauge 60 is mounted on arm 65, and it measures the deflection of the arm 65. The strain gauge 60 sends a signal to amplifier 63, which amplifies the signal by a predetermined amount. The amplified signal is then sent to the controller 62 where the signal is then mathematically processed and compared to a set point. Then, controller 62 sends the resulting data to an electronic to pneumatic regulator 63, which together with actuator 67, make any necessary adjustments in pressure to arm 65. In a preferred embodiment, the regulator 63 is pneumatically connected with the actuator 67. Actuator 67 is preferably an air cylinder having a housing 69 and a piston 68 that is configured to contact arm 65.

Advantageously, the deflection force is being monitored from arm 65 rather than on a load cell with an up/down mechanism. This way, the deflection force being measured is not interfered with by friction in the up/down mechanism or the pivot joint that can result from poor lubrication or fallen slurry. This means that the strain gauge intended for the use in the preferred embodiment can have more accurate force readings. Further, including the strain gauge on the arm 65 rather than the end effector 70 reduces the complexity, cost, and size of the end effector 70.

END EFFECTOR

Figure 4:
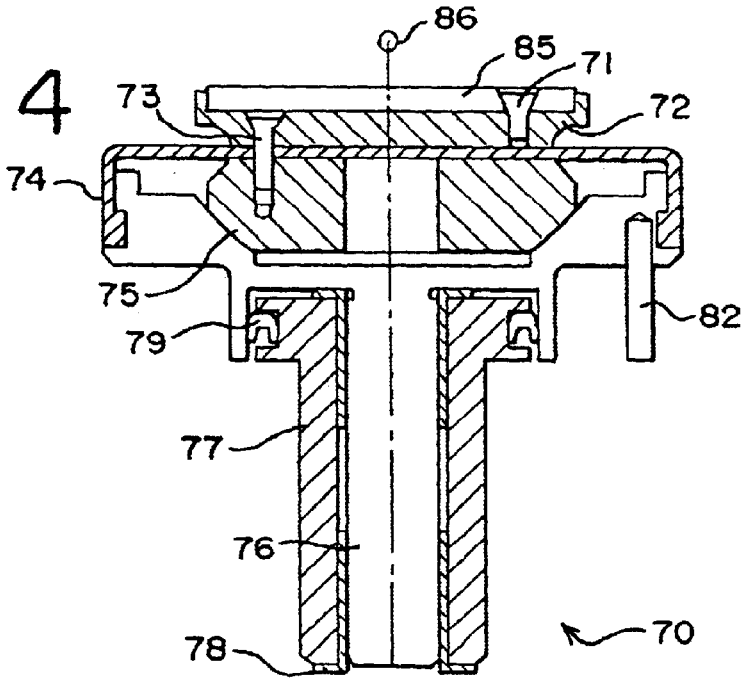
FIG. 4 shows an end effector that can be used on the conditioning mechanism of FIG. 2.

Referring to FIG. 4, a preferred embodiment of the end effector 70 is shown. The end effector 70 supports conditioning pad 85. Conditioning pad 85 is preferably disk-shaped, but it can be any shape that is securable into the end effector 70 and conditions the polishing member 12 evenly. Preferably, conditioning pad 85 has an abrasive surface including diamond grit to condition the polishing member 12. The diamond grit may have a density of 50 to 200 grit. Preferably, the diamond grit is dispersed randomly along the surface of the conditioning pad 85.

The conditioning pad 85 rests directly on base 72. Base 72 can be made of any material that provides adequate support for conditioning pad 85. The material can be stainless steel such as stainless steel 316 or 440C. In one embodiment, stainless steel 440C is preferred because its additional carbon content gives it desirable magnetic properties. Either material is commercially available from companies such as Penn Stainless Products in Quakertown, Pa. In embodiments where a stainless steel with magnetic properties is preferred, it is also preferred that conditioning pad 85 have a layer of material on it so that conditioning pad 85 has a magnetic attraction to the stainless steel of base 72 to secure conditioning pad 85 in place.

A securing mechanism, such as a flat head screw 73, secures the base 72 to a spherical bearing surface 75 through a membrane 74. The spherical bearing surface 75 allows the conditioning pad 85 and base 72 to rotate about gimbal point 86. Advantageously, the gimbal point 86 is external to end effector 70. The external location of the gimbal point 86 prevents uneven wear of conditioning pad 85. If the gimbal point 86 were internal to end effector 70, the front edge of conditioning pad 85 tends to dig into polishing member 12, causing the front edge to wear out prematurely, while the middle area of conditioning pad 85 gets little or no use.

Screw 73 and membrane 74 prevent base 72 and conditioning pad 85 from moving too far in any one direction. Screw 73 and membrane 74 keep the conditioning pad 85 centered.

Spherical bearing surface 75 is preferably made of a bearing grade plastic. Examples of such plastics are PEEK bearing grade, TEFLON, TURCITE A&X, RULON LR, and TORLON 4301, each of which is available companies such as Interstate Plastics, Inc. in Sacramento, Calif. A preferred plastic is ERTALYTE PET-P available from DSM North America, which is headquartered in Heerlen, the Netherlands.

Membrane 74 is preferably made of a flexible, durable, strong rubber-like material having physical characteristics similar to EPDM, a terpolymer of ethylene, propylene, and diene. EPDM and other acceptable materials for membrane 74 are commercially available through DSM North America, which is headquartered in Heerlen, the Netherlands. Membrane 74 allows the base 72 and conditioner pad 85 to be self-centering relative to the end effector 70.

A spindle 76, the support for bearing surface 75, rotates inside of a stationary housing 77. The spindle 76 preferably rotates about a vertical axis dropped from gimbal point 86. The spindle 76 can be nearly any plastic or steel material strong enough to support bearing surface 75 and endure its rotational motion. Preferably, spindle 76 is stainless steel 316.

Stationary housing 77 is attached to arm 65 by any attachment means or mechanism known in the art. It can be attached using mechanisms such as pins, bolts, screws, and the like. It can be attached using adhesives. It can be attached through welding and molding and other like techniques.

A bearing 78 exists between a portion of the spindle 76 and the interior surface of stationary housing 77. Preferably, the bearing 78 is stationary. Preferably, bearing 78 comprises a slippery-type material such as a TEFLON or other slippery, low friction materials available through companies such as IGUS, based in Köln, Germany.

A friction-causing member 79 also exists between another portion of the spindle 76 and a portion of the external surface of stationary housing 77. Although many known friction-causing members may work with this embodiment, preferably, the friction-causing member 79 is a U-ring. An O-ring may also be used U-rings are preferred because of t heir shape. When the legs of the U continue to push outward to compensate for wear and tear on the legs of the U. The friction-causing member 79 preferably causes 20 enough friction so that the spindle 76 does not rotate during conditioning. Yet, the friction caused by friction-causing member 79 must be of a magnitude that can be over come when it is desired to rotate spindle 76, such as when the arm 65 is in a home position away from the polishing member 12. Preferred materials are rubbers such as EPDM and others that are well known in the art.

Rotation pin 82 is one of a plurality of pins, preferably 6 or 8 or 10 pins spaced evenly through the spindle 76, that guide the rotation of spindle 76 when the conditioning mechanism 50 is in a home position, or any other position away from the bottom region of linear polishing apparatus 10. The rotation pin 82 and its counterpoints guide rotation of spindle 76 by pushing against a stationary ratchet member at the home position, or a position away from the polishing member 12.

SCOPE

It is intended that the foregoing detailed description be regarded as illustrative rather than limiting, and that it be understood that the following claims, including all equivalents, are intended to define the scope of this invention.

What is claimed is:

1. A conditioning mechanism in an apparatus for chemically-mechanically polishing semiconductor wafers, the mechanism comprising:

(a) a drive mechanism (b) an arm having a first end portion, a mid portion, and a second end portion wherein the first end portion is connected with the drive mechanism;

(c) an end effector mounted to the second end portion of the arm, the end effector including a flexible membrane for supporting a conditioning member, wherein the conditioning member is self-centering relative to the end effector; and (d) a strain gauge configured to monitor the force that the end effector, with the conditioning member therein, applies to the polishing member.

2. The conditioning mechanism of claim 1 wherein the drive mechanism is configured to move the arm.

3. The conditioning mechanism of claim 2 wherein the drive mechanism is configured to move the arm back and forth in a sweeping, horizontal plane.

4. The conditioning mechanism of claim 2 wherein the drive mechanism is configured to move the arm up and down in a vertical plane.

5. The conditioning mechanism of claim 3 wherein when the drive assembly moves the arm back and forth in a sweeping, horizontal plane, the conditioning member conditions the polishing member.

6. The conditioning mechanism of claim 4 wherein when the drive assembly moves the arm up, the conditioning member is brought into contact with the polishing member.

7. The conditioning mechanism of claim 4 wherein when the drive assembly moves the arm down, the conditioning member removes the conditioning member from contact with the polishing member.

8. The conditioning mechanism of claim 1 wherein the strain gauge monitors the force applied to the polishing member by measuring a feedback force in the mid portion of the arm.

9. The conditioning mechanism of claim 1 wherein the conditioning member supported by the end effector rotates about a gimbal point.

10. The conditioning mechanism of claim 9 wherein the gimbal point is a greater distance from the conditioning member in the end effector in a direction than the distance from polishing member in the same direction.

11. The conditioning mechanism of claim 9 wherein the rotation of the conditioning member is not motorized.

12. The conditioning mechanism of claim 1 wherein the conditioning member and end effector make one complete rotation for each wafer that is completely polished in the apparatus for chemically-mechanically polishing semiconductor wafers.

13. The conditioning mechanism of claim 1 wherein the membrane is made from EPDM.

* * * * *